United States Patent [19]

Stoll et al.

[11] 4,447,161

[45] May 8, 1984

[54] PNEUMATIC TIMER

[76] Inventors: Kurt Stoll, Lenzhalde 72, 7300 Esslingen, Fed. Rep. of Germany; Hans-Heinrich Glaettli, Seestr. 252, CH-8700 Küsnacht ZH, Switzerland

[21] Appl. No.: 375,530

[22] Filed: May 6, 1982

[30] Foreign Application Priority Data

May 14, 1981 [DE] Fed. Rep. of Germany ..... 3119089

[51] Int. Cl.[3] ..... G04B 1/26; G04B 9/00

[52] U.S. Cl. ..... 368/65; 368/89

[58] Field of Search ..... 368/65, 89

[56] References Cited

U.S. PATENT DOCUMENTS 598,066 1/1898 Hahl ..... 368/65

1,730,448 10/1929 Bryce ..... 368/65

FOREIGN PATENT DOCUMENTS 2204667 8/1972 Fed. Rep. of Germany .

*Primary Examiner*—Bernard Roskoski

*Attorney, Agent, or Firm*—Flynn, Thiel, Boutell & Tanis

[57] ABSTRACT

A pneumatic timer has a mark or pointer which is moved as long as the timer is in operation. The timer has a face plate supporting the adjustment knob for a choke and having a window through which the mark or pointer may be seen. The mark is on a support which is moved on the back side of the window by the free end of a bellows.

18 Claims, 5 Drawing Figures

PNEUMATIC TIMER

FIELD OF THE INVENTION

The present invention relates to a pneumatic timer and, more particularly, to a pneumatic timer having a housing with a bellows placed in the housing and joined pneumatically in series with an adjustable choke controlled by a part on a face plate of the housing. An example of such a timer is to be seen in German Offenlegungsschrift No. 2,204,667.

BACKGROUND OF THE INVENTION

As generally used, such timers have a block-like structure with smooth sides and, for pneumatic control systems, are placed right next to each other or next to other control parts so that only the front ends or face plates of the timer may be seen and may be freely accessed, with the adjustment knobs for the chokes on them.

Such timers are produced with a wide range of adjustment of the time and in view of the great effects which even small tolerances in making the timers have on the times selected on the timers, it is frequently necessary for a stop-watch to be used for checking out the preset time, and not simply to make use of the scale on the timer. Checking out a slow timer (whose preset time may go up to some minutes) is a slow process, because in the case of known timers, it is only when the preset time has run to an end that it is possible to see if the adjustment of the timer is right. The fact that the preset time has run to an end will be seen because of a load being turned on or because of the next stage in a pneumatic program control system being put into operation. It is more specially on checking out the operation of a pneumatic program control system having a number of such timers non-linearly cascaded together that such adjustment is likely to be a very slow process.

SUMMARY OF THE INVENTION

For this reason, one purpose of the present invention is that of designing a pneumatic timer in the case of which the time adjustment made may be checked out by eye while the timer is still running and before the end of the full time, by looking at the face plate of the housing with the knob for operation of the adjustable choke thereon.

For effecting this purpose, and further purposes, the timer of the present invention has a mark support designed to be moved parallel to the face plate, such mark support being joined up by a connection system with a free end of the bellows so that when this end of the bellows is moved along the axis of the bellows, the mark is moved parallel to the plane of the face plate, the face plate being transparent or having an opening so that it is possible to see the motion of the mark representative of operation of the bellows.

The timer of the present invention may be placed right up against other such timers as is the case with prior art systems, or next to other components of a pneumatic program control system, while on the other hand making possible very much quicker adjustment of the timer. In this respect, using the mark or pointer on the mark support and a number of scale marks on the housing, it is possible to quickly get a rough idea of the timing of the timer simply by timing for example 10% of the motion of the bellows and then roughly scaling up the time to the full time needed for motion of the bellows so as to get a precise adjustment of the timer. To get an even more exact adjustment, the time taken for 50%, for example, of the bellows motion may be measured before scaling up. It is only for the last adjustment that the timer's bellows is caused to go through its full motion.

A further useful effect of the timer of the invention is that the stage or progress of a timing operation may be seen readily at any time. This makes it quickly and simply possible to keep an eye on the operation of a pneumatic program control system with timers and makes it very much simpler to put such a system right when it is not in order.

As part of a further development, the mark is on a marker sleeve centered on the axis of the bellows and having a helical camming slot thereon so that it may be turned by a nosepiece on the free end of the bellows. The mark or pointer is then able to be seen in a ring-like window like the hand of a clock. Such a system gives a high resolution of readings while needing little space, because the marker sleeve placed coaxially around the bellows takes up little space and the connection system between the bellows and the sleeve may readily be placed radially and axially within the sleeve. A connection system is only made up of a small number of moving parts which may be simply made.

As a further development of the invention the marker sleeve is turningly supported on an outer cylindrical face of the adjustable choke. With this further development of the invention, the timer housing does not have to have any separate guide faces for the marker sleeve and the sleeve and choke together with the bellows on the choke may be pre-assembled. This makes it very much simpler for the timer to be put together.

The marker sleeve may have at least one gripping nosepiece locking into a groove in the choke, this making it simple to get the choke sleeve locked in the desired axial position.

As a still further development of the invention, there may be a number of such nosepieces placed next to axial arms, which are circumferentially spaced, of the marker sleeve, such arms furthermore being axially lined up with air outlet openings of the adjustable choke. With this design of the timer of the invention, the locking nosepieces on the marker sleeve may be very simply fixed on the choke housing, because the axial arms of the marker sleeve may be springingly moved back somewhat while at the same time the edge cutouts between the axial arms make certain that there is nothing in the way of the air outlet openings of the choke housing.

In the case of a further form of the invention, the mark support is in the form of a tape whose one end is fixed to the free end of the bellows, while the other end is fixed to a spring so that as the expansion of the bellows takes place, the mark, which is on the tape, is pulled along a narrow window in the face plate, this giving a linear readout for the position of the bellows.

The spring joined with one end of the tape may be a long, weak spring so that the pull on the mark tape acting on the system in one end position has no effect on the function and properties of the timer, this being because the force acting on the bellows by way of the tape is generally not dependent on the position of the free bellows' end.

As a further development of the invention, the mark support may be in the form of a marker lever while the connection system takes the form of a turning point between one end of the lever and the bellows' free end and a straight line system on the other end of the lever. This system gives linear readings for the operation of the timer while the system for driving the mark is specially simple. This system only has rigid components which may be very easily produced and put together.

Furthermore, the joint may be joined up by way of a radial arm with the free bellows' end, such arm running out as far as a position near one of the side walls of the housing. Such a design of the invention gives a specially wide range along which the mark on the lever may be moved without having to go through a dead center position.

It is furthermore possible for the straight line guide to be in the form of a guide lip spaced from the free edge of one of the side walls and a guide pin on the free end of the lever so that the pin may be moved between the guide lip and back side of the face plate. Such a design makes it very simple for the timer to be assembled inasfar as the bellows, the choke and the mark on the mark support may be pre-assembled as one part of the timer which then only has to be slipped into the housing.

BRIEF DESCRIPTION OF THE DRAWINGS

In FIG. 1 the reader will see a pneumatic timer with a prismatic housing 10 of synthetic resin which is longer than it is wide and which is shut off at one end by a cover 12 of glass-clear synthetic resin. Housing 10 furthermore has an end wall 14 and upright and horizontal walls 16 and 18 joining the face plate with the back wall 14.

Figure 1:
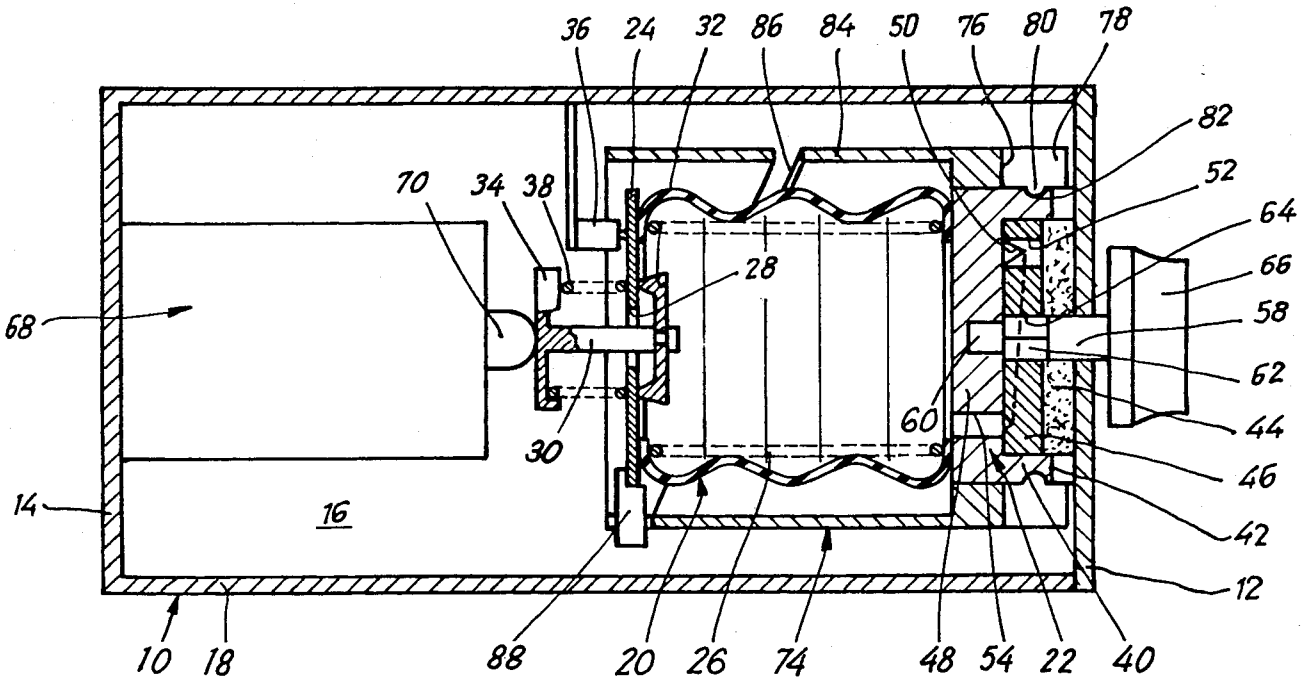
FIG. 1 is a lengthways sectional view of a pneumatic timer with an integrated time measuring mark, taken on the line I—I of FIG. 2.

The main part of the timer is in the form of a pneumatic capacitor or bellows 20, whose one end is air-tightly joined to the free back face of a choke housing 22 which is joined, for example by adhesive, with and supported by cover 12. The other end of bellows 20 is air-tightly shut off by an end plate 24. Inside bellows 20 there is a helical compression spring 26 pushing the bellows into the stretched-out position to be seen in the figure.

In the middle of end plate 24 there is a valve opening 28 having a valve stem 30 running therethrough, the right hand end (that is to say to the right in FIG. 1) having a somewhat elastic valve plate 32 thereon inside bellows 20. The second, other end of valve stem 30 has a spring backup plate 34 against which the left hand end of the helical compression spring 38 is rested, the other, right hand end of this spring resting against the outer left hand side of end plate 24. Spring 38 is much less hard or stiff than helical compression spring 26.

The position of the uncovered side of end plate 24 (to be seen on the left in FIG. 1) is sensed by a pneumatic limit feeler 36 which is supported by housing 10 and which has the function of controlling a load or some further control unit forming part of the same program control system as the timer.

On pushing spring backup plate 34 to the right in FIG. 1 against the force of the helical compression spring 38, valve plate 32 is moved clear of end plate 24 and the air within the bellows is then let off by way of valve opening 28 into the space in housing 10 outside the bellows, the bellows 20 being compressed.

On expansion of the compressed bellows 20 caused by the force of helical compression spring 26 with the spring backup plate 34 freed, that is to say able to take up the position to be seen in FIG. 1, air makes its way out of the space within housing 10 into inlet openings 42 in an outer round wall 40 of the cup-like choke housing 22, such inlet openings being cutouts or crenellations in the free edge of such wall 40 and being equally spaced round the wall. After making its way through openings 42, the air goes into a filter plate 44 of open-pored elastic filter material and then goes by way of a choke groove plate 46 into the space inside bellows 20. The side face, which is to be seen on the right in FIG. 1, of filter plate 44 is rested against cover 12, its side to be seen on the left in FIG. 1 forcing the choke groove plate 46 elastically and flatly against the end wall 48 of the choke housing 22 so as to make an air-tight seal.

In the side of the choke groove plate 46 to be seen on the left in FIG. 1 there is an arcuate choke groove 50, whose center point is centered on the axis of the choke groove plate 46, the three-cornered cross-section of the choke groove smoothly changing in a circumferential direction. In the present working example the cross-section of choke groove 50 is in the form of an equilateral triangle, the depth of the choke groove 50 increasing linearly in the circumferential direction.

At its end with the greatest cross-section, choke groove 50 is joined up by way of a hole 52 which is parallel to the axis and is provided at the side to be seen on the right in FIG. 1 of the choke groove plate 46 so that, by way of filter plate 44, it is joined up with the space inside housing 10.

In line radially with the middle line of the choke groove 50 there is a let-off opening 54 in the end plate 48 of the choke housing 22, such let-off hole or opening 54 being placed radially within the bellows 20, opening through the side (to be seen on the left in FIG. 1) of the choke housing 22.

A timer adjustment shaft 58 extends to a location outside of the timer and is rotatably supported in cover 12, and inside the timer its end part 60, having a smaller diameter than the rest of the shaft 58, is rotatably supported in the end plate 48 of the choke housing 22. The left hand end part 62 of the timer adjustment shaft 58 has a square cross-section and is keyed into a hollow 64 of the same size in the choke groove plate 46, while the outer end of the timer adjustment shaft 58 has a grip 66 fixed thereon.

An air-powered driving cylinder 68, which is only outlined in the figure, is supported on the end wall 14 of housing 10, the rounded off end of the piston rod 70 of the cylinder being designed for acting against spring backup plate 34.

On the outer face of the choke housing 22 a marker sleeve 74 is slipped so that it may be readily turned. It is made of injected synthetic resin having the property of running lightly on the material of the choke housing 22. At the end nearest the cover the marker sleeve has cutouts 76 at its edge for leaving uncovered the inlet openings 42 in the choke housing 22, such cutouts 76 being separated by axial arms 78, each of which has a nosepiece 80 taken up in a groove 82 in the outer face of choke housing 22 so that the marker sleeve 74 is axially keyed on the choke housing 22.

In the outer face 84 of marker sleeve 74, there is a helical camming slot 86 stretching through an angle of in all 300° round the axis of the sleeve 74, the axial length of such slot 86 being the same as the axial motion of bellows 20. A cam driver pin 88 is taken up in camming slot 86 and is joined to the end plate 24 so as to be running out radially therefrom like an arm.

Figure 2:
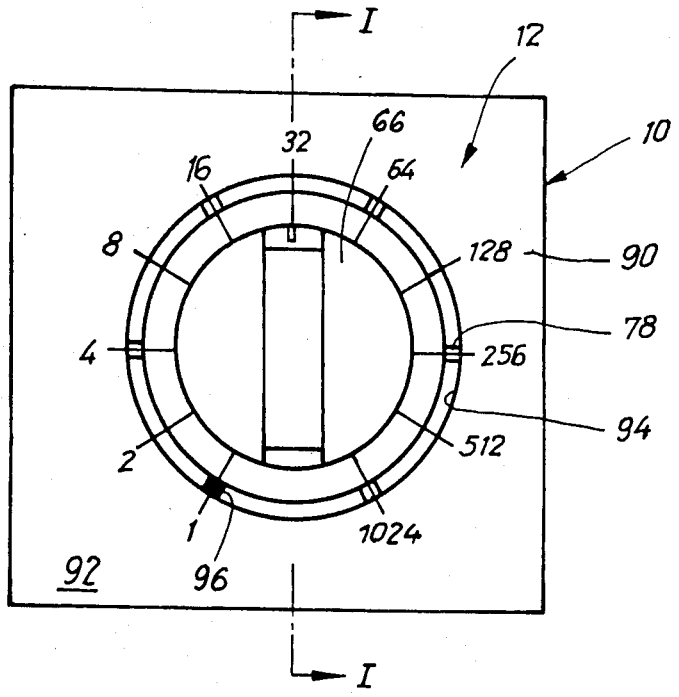
FIG. 2 is a view looking towards the face plate of the timer of FIG. 1.

As may best be seen from FIG. 2, the cover 12, made of glass-clear material, has a scale 90 printed thereon for use with the grip 66, there being colored coating 92 provided behind the scale 90 so that the user is not able to see into the inside of the timer, although a round window 94 is kept clear so that the user is able to see the free end faces of the axial arms 78 of marker sleeve 74. One of these end faces, marked at 96, is brightly colored for use as a mark or pointer, so that the user is able to take a reading for the position of bellows 20 at any desired point in time.

An account will now be given of the workings of the present timer.

On putting the pneumatic cylinder 68 under pressure, the piston rod 70 is forced out to the right so that the valve plate 32 is moved and uncovers the valve opening 28. As the piston rod 70 goes out further to the right, the bellows 20 is forced together, such motion being paralleled by a turning of marker sleeve 74 through 300° (for full motion of the piston rod 70) by cam driving pin 88 placed in the camming slot 86, with the outcome that the mark or pointer on the end face 96 will give the reading "1024" on scale 90.

If the piston rod 70 is now quickly moved back again (this being done for example by quickly letting off the air therefrom in the case of a simple pneumatic cylinder having a spring for forcing it back into its starting position), the valve plate 32 will go back into its position covering valve opening 28. Under the force of the helical compression spring 26 and in a way dependent on the adjustment of the angle of the choke groove plate 46, air will be able to make its way at a quicker or slower rate into the bellows 20 through the inlet opening 46, the filter plate 44 and the adjustable choke system which is walled in by the end plate 48, the let-off hole 54 in the choke housing 22 and the choke groove 50 itself.

In step with the expansion of bellows 20 back into its starting position, the pointer on end face 96 will be turned, the direction being anti-clockwise in FIG. 2 so that the user will readily be able to keep an eye on the operation of the timer, even when the timer is in fact working. This makes it simpler for the time measured out by the timer to be changed using a stopwatch, because from the readings between the end of the scale it is possible to get a general idea of the speed at which the timer is working and, for this reason, the overall time taken, and it is not necessary to keep on waiting till the bellows 20 has gone right back into its starting position. Furthermore it is readily possible to see if the timer is in order, that is to say that there is for instance no "sticking" of its parts in the middle of a timing operation.

Figure 3:
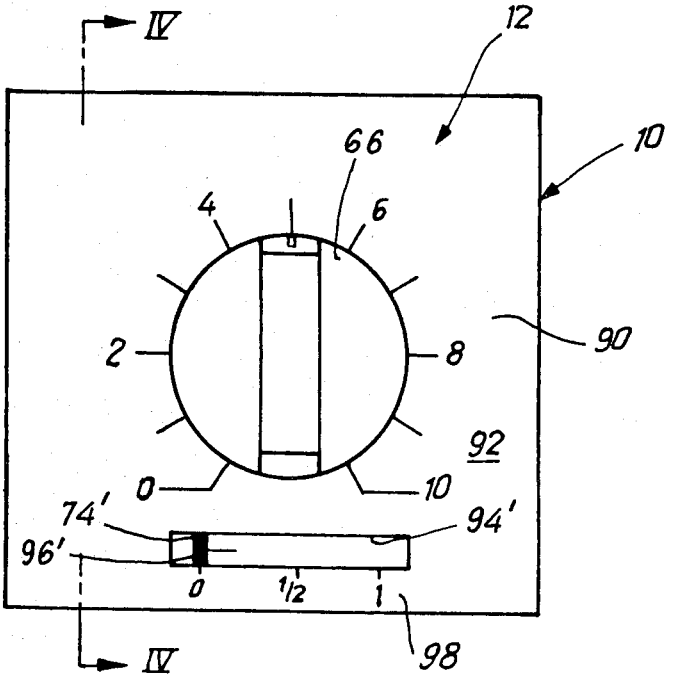
FIG. 3 is a view looking towards the face plate of a somewhat changed form of timer with an integrated time measuring mark.

FIG. 3 is the end-on view of a somewhat changed form of pneumatic timer of the present invention, parts thereof which are to be seen in FIG. 2 being parts with the same part numbers.

In this case, however, window 94' is rectangular and placed stretching parallel to the lower edge of cover 12.

To the back of window 94', in the length direction of the window, there is a marker tape 74' having a mark or pointer 96' thereon. Under window 94' there is a second scale 98.

Figure 4:
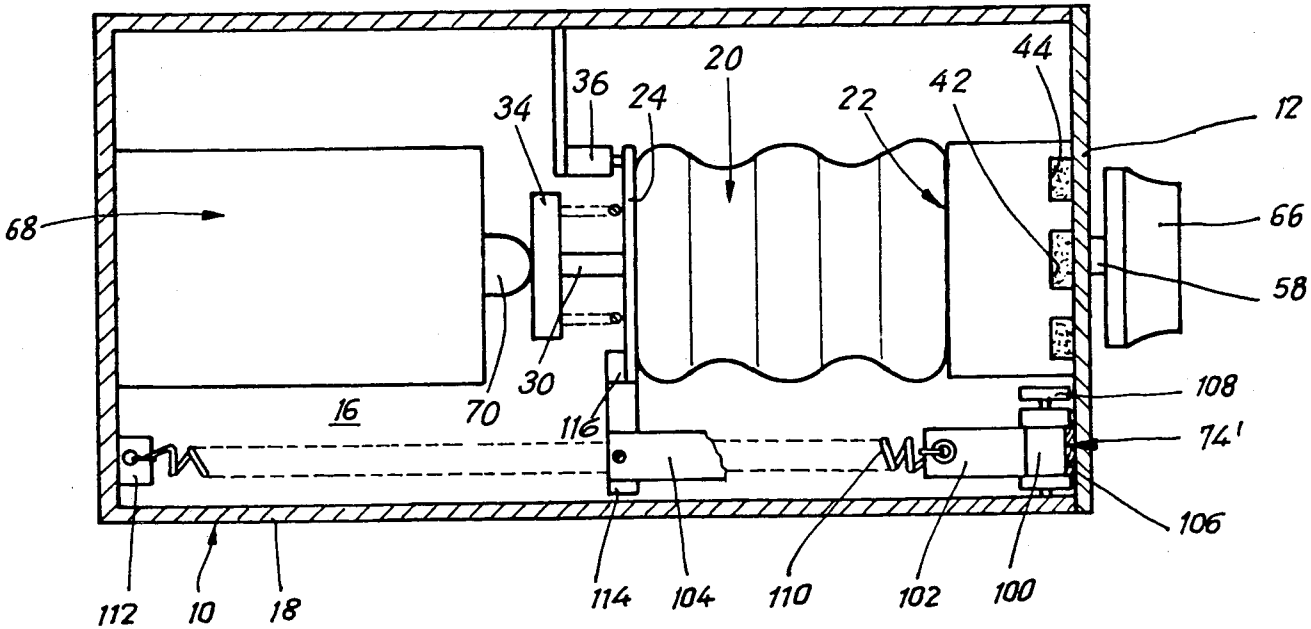
FIG. 4 is a lengthways section through the timer of FIG. 3 on the line IV—IV as marked in FIG. 3.

Turning now to FIG. 4, it is possible to see details of the parts for guiding and driving marker tape 74'. Two guide wheels 100, placed at the front lower ends of the upright walls 16, are used for changing the direction of the outer run 102, 104 of marker tape 74' out of the plane of the cover and into a plane parallel to the axis of housing 10 and in a direction parallel and near to one of the side walls 16 while at the same time making certain that the middle run 106, placed between the wheels 100, is right up near the window 94'. Guide wheels 100 each have an axle rotatably supported in openings in the lower wall 18 and in a finger 108 provided on the side wall 16. If desired, the guide wheels might be rotatably supported by fingers or plates or the like fixed to cover 12.

The end of the outer run 102 is joined up with a long, weak tension spring 110 whose other end is fixed to a finger 112 on the end wall 14 of housing 10. The end of the outer run 104 is hooked into or screwed to a support 114 so that it may be undone therefrom, the support being fixed to an arm 116 supported by end plate 24, the general design being such that the run 104 of marker tape 74' is parallel to the side wall which is cut away in FIG. 4.

In the timer of FIGS. 3 and 4, the marker tape 74' is moved in step with the end plate 24 of bellows 20 and the mark 96' or pointer on it makes it possible for the user to keep an eye on the operation of the timer.

Figure 5:
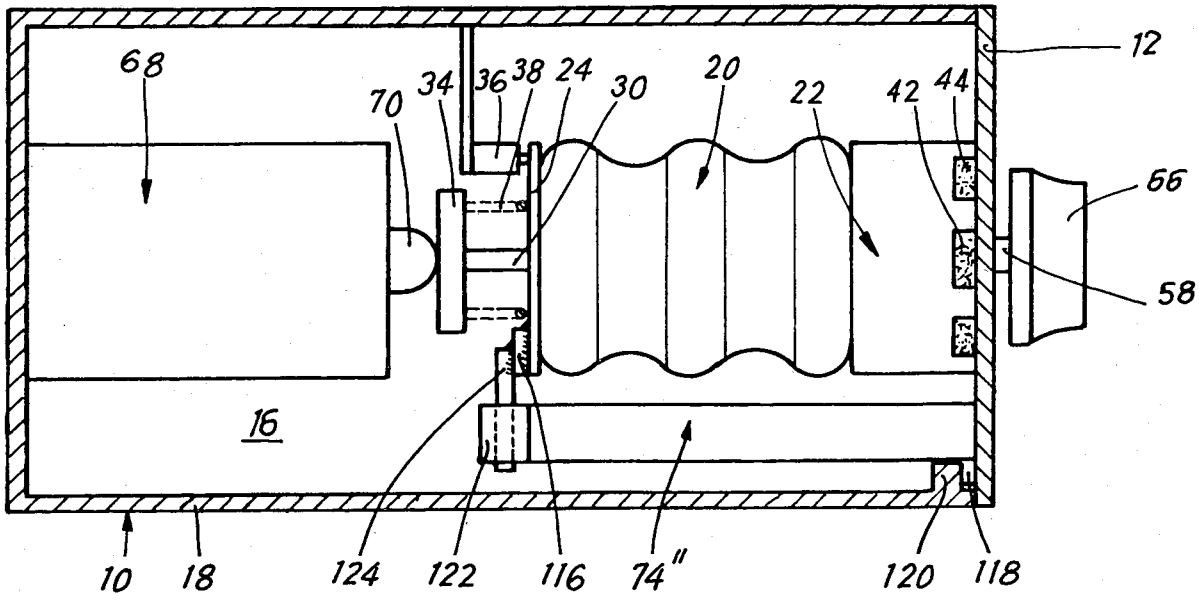
FIG. 5 is a lengthways section generally on the same lines as in FIG. 4, but through a somewhat changed form of timer with an integrated time measuring mark.

The further timer to be seen in FIG. 5 has a cover 12 which is designed on the same lines as the timer of FIG. 3 and FIG. 4, but for the fact that the mark or pointer 96' is on the free end face of a pointer lever 74". On the end part of pointer lever 74" there is a guide pin 118 slidingly received between a guide lip 120 running parallel to the lower side wall 18 (parallel to the cover 12) and the back side of the cover 12 itself.

A bearing head 122 is molded on the inner end of pointer lever 74" so as to rotatably receive a turnpin 124, which, again, is on the outer or lower end of arm 116 which extends out as far as a position near to the housing side wall which, in FIG. 5, is cut away. The length of the pointer lever 74" is such that in the "rundown" position of the timer as seen in FIG. 5, the lever 74' is substantially parallel to the plane of the figure.

It will be clear to the reader that in the working example of FIG. 5 the scale 98 used with window 94' is not a linear but a sine-law scale to be in line with the sine-law translation of the motion of the end plate 24 into the motion of the free end of pointer lever 74" which has the mark 96' or is itself the mark or pointer.

In the timer of FIG. 5, there are two completely separate groups of parts which are pre-assembled and which may be readily put together, that is to say the housing 10 with the pneumatic driving cylinder 68 and the cover 12 with the bellows 20, the adjustable choke and the marker representative of the operation of the timer.

The function of the timers of which a detailed account has been given is in effect the same in each case. It will be clear that the direction of motion of the pointer or mark may be very easily reversed, that is to say in the timer of FIG. 1 and FIG. 2 by having a camming slot 86 of opposite hand, and in the case of the timers of FIGS. 3 to 5 by having the arm 116 placed to extend in the opposite direction and toward the other of the two side walls 16 to be seen in FIGS. 4 and 5.

The embodiments of the invention in which an exclusive property or privilege is claimed are defined as follows:

1. In a pneumatic timer which includes a housing, a bellows supported in said housing so that an axis of expansion of said bellows is substantially normal to a faceplate which forms an end of said housing, said bellows having an end movable relative to said faceplate in a direction parallel to said axis of expansion, an adjustable choke joined in series pneumatically with a space in said bellows, and a choke adjusting part movably supported on said faceplate and operatively coupled to said choke, the improvement comprising a mark support supported in said housing for movement parallel to said faceplate, a connection system operatively coupling said mark support and said end of said bellows so that motion of said bellows in the direction of said axis effects movement of said mark support parallel to said faceplate, said mark support having a mark thereon and said mark being visible through said faceplate, movement of said end of said bellows causing said mark to move a distance representative of the distance moved by said end of said bellows.

2. A timer as claimed in claim 1, including a stiff end plate provided at said end of said bellows, said end plate being coupled to an input portion of said connection system which translates motion of said bellows into movement of said mark support.

3. A timer as claimed in claim 1, wherein said mark support includes a marker sleeve, said marker sleeve encircling said bellows and being supported for rotation about an axis parallel to said axis of bellows, said connection system including helical camming means on said marker sleeve and a driver pin engageable with said camming means, said driver pin being supported on said end of said bellows.

4. A timer as claimed in claim 3, wherein said camming means includes a helical camming slot, said driver pin being slidably received in said camming slot.

5. A timer as claimed in claim 4, including means defining a cylindrical outer surface on said choke, and wherein said marker sleeve is rotatably supported on said cylindrical outer surface of said choke.

6. A timer as claimed in claim 5, wherein said marker sleeve has at least one nosepiece thereon which slidably engages a groove provided in said cylindrical outer surface of said choke.

7. A timer as claimed in claim 6, wherein said choke has a plurality of circumferentially spaced let-off openings, wherein said marker sleeve has a plurality of circumferentially spaced, axially extending arms, and wherein said marker sleeve has a plurality of said nosepieces which are each provided next to a respective said circumferentially spaced, axially extending arm, said arms being axially aligned with said let-off openings of said choke.

8. A timer as claimed in claim 1, wherein said mark support includes a mark tape, a tension spring, and means supporting said tape so that it has a first run extending parallel to said axis of said bellows, a second run extending generally parallel to said axis of said bellows and connected to said end of said bellows, and a third run located between said first and second runs, said tension spring being operatively connected to said first run of said tape and said third run being parallel to said faceplate.

9. A timer as claimed in claim 8, wherein said tension spring is long and weak.

10. A timer as claimed in claim 1, wherein said connection system includes a pointer lever having a first end which serves as said mark support, a second end of said pointer lever being coupled to said end of said bellows, and wherein said connection system includes means defining a linear guide cooperable with said first end of said pointer lever for guiding said first end of said pointer lever for movement in a direction parallel to said faceplate.

11. A timer as claimed in claim 10, wherein said connection system includes an arm extending from said end of said bellows to a position near a side wall of said housing, said pointer lever being operatively coupled to said arm.

12. A timer as claimed in claim 11, wherein said means defining said linear guide including a guide lip spaced a small distance from a rear side of said faceplate of said housing, and includes a guide pin provided at said first end of said pointer lever, said guide pin being slidably received between said guide lip and said rear side of said faceplate.

13. A timer as claimed in claim 1, wherein said faceplate has a glass-clear window through which said mark may be seen.

14. A timer as claimed in claim 1, wherein said faceplate has an opening through which said mark may be seen.

15. A pneumatic timer, comprising: a faceplate; a control member movably supported on one side of said faceplate; a bellows supported on the side of said faceplate opposite said one side and having two ends, said ends of said bellows being movable toward and away from each other between first and second positions and being closer to each other in said second position than in said second position; resilient means for yieldably urging said ends of said bellows toward said first position; selectively actuable means for effecting movement of said ends of said bellows from said first position to said second position against the urging of said resilient means; means for facilitating a rapid escape of gas from the interior of said bellows to the exterior thereof as said ends of said bellows are moved from said first to said second position; means defining a passageway providing fluid communication between the interior of said bellows and the exterior thereof; adjustable choke means operatively coupled to said control member for selectively varying the cross-sectional area of a portion of said passageway in response to movement of said control member in order to control the rate of flow of gas through said passageway from the exterior to the interior of said bellows as said ends thereof are moved from said second position to said first position by said resilient means; a mark support supported in the region of said faceplate on said side thereof opposite said one side for movement relative to said faceplate in directions approximately parallel thereto between third and fourth positions, said mark support having a mark thereon on a side thereof facing said faceplate; and means operatively coupling said bellows and said mark support for effecting movement of said mark support between said third and fourth positions in response to movement of said ends of said bellows between said first and second positions; wherein said faceplate has means for facilitating observation of said mark on said mark support from said one side of said faceplate.

16. The timer according to claim 15, wherein said bellows has an approximately cylindrical shape, the axis of said bellows extending approximately normal to said faceplate; including means fixedly supporting one said end of said bellows against movement relative to said faceplate; including a cylindrical sleeve coaxially surrounding said bellows and means supporting said sleeve for rotation about the axis of said bellows, said mark support being an axial end of said sleeve which is adjacent said faceplate; and wherein said means operatively coupling said bellows and said mark support includes means defining a helical slot on said sleeve and a driver pin which is fixedly secured to the other said end of said bellows and is slidably received in said helical slot.

17. The timer according to claim 15, wherein one said end of said bellows is fixed against movement relative to said faceplate; including an elongate tape having one end secured to the other end of said bellows; including means guiding said elongate tape so that a portion thereof is adjacent and substantially parallel to said faceplate, a segment of said portion of said tape being said mark support; and including further resilient means cooperable with the other end of said elongate tape for maintaining said tape under lengthwise tension; movement of said other end of said bellows effecting lengthwise movement of said tape and causing said segment thereof which is said mark support to move relative to said faceplate.

18. The timer according to claim 15, wherein one said end of said bellows is fixed against movement relative to said faceplate and the other end thereof moves toward and away from said one end in a direction substantially normal to said faceplate; and wherein said means for operatively coupling said bellows and mark support includes means defining a guideway adjacent and substantially parallel to said faceplate and a lever having one end supported on said other end of said bellows for pivotal movement about an axis which is substantially parallel to said faceplate, the other end of said lever being said mark support and having a pin which is slidably received in said guideway.

* * * * *

UNITED STATES PATENT AND TRADEMARK OFFICE

CERTIFICATE OF CORRECTION

PATENT NO. : 4,447,161

DATED : May 8, 1984

INVENTOR(S) : Kurt Stoll

It is certified that error appears in the above-identified patent and that said Letters Patent is hereby corrected as shown below:

Column 8, line 40; change "second" to ---first---.

Signed and Sealed this

*Eleventh* Day of *September 1984*

[SEAL]

*Attest:*

GERALD J. MOSSINGHOFF

*Attesting Officer*

*Commissioner of Patents and Trademarks*